US005116224A

United States Patent [19]

Kelsey, Jr.

[11] Patent Number: 5,116,224

[45] Date of Patent: May 26, 1992

[54] DEVEL SMALL ARMS BULLET

[76] Inventor: Charles C. Kelsey, Jr., 1601 Hollyhurst, c-21, Houston, Tex. 77056

[21] Appl. No.: 542,889

[22] Filed: Jun. 25, 1990

[51] Int. Cl.[5] ..... F42B 12/00

[52] U.S. Cl. ..... 102/439; 102/501; 102/517

[58] Field of Search ..... 102/398, 439, 501, 517-519

[56] References Cited

U.S. PATENT DOCUMENTS

| | | | |
|---|---|---|---|
| 2,343,344 | 3/1944 | Thompson | 102/519 |
| 2,401,380 | 6/1946 | Teitscheid | 102/519 |
| 3,572,250 | 3/1971 | Kriesel et al. | 102/398 |
| 4,829,904 | 5/1989 | Sullivan | 102/439 |

FOREIGN PATENT DOCUMENTS

| | | | |
|---|---|---|---|
| 577406 | 6/1959 | Canada | 102/501 |
| 346779 | 12/1989 | European Pat. Off. | 102/398 |
| 427713 | 8/1911 | France | 102/501 |

*Primary Examiner*—Harold J. Tudor

*Attorney, Agent, or Firm*—Pravel, Gambrell, Hewitt, Kimball & Krieger

[57] ABSTRACT

A cartridge bullet having a truncated conical nose with radial rearwardly extending ribs with grooves defining curved surfaces between the ribs.

7 Claims, 1 Drawing Sheet

DEVEL SMALL ARMS BULLET

This invention relates to small arms bullets for use in semi-automatic pistols, shotguns, revolvers, rifles, carbines, submachine guns as well as light and heavy machine guns. The types of commercially available large caliber pistol bullets such as 0.45 automatic, 10 mm, 0.38 super and 9 MM Luger in current use are:

1. Pistol ball ammunition using full metal jacket round nose bullets with lead core,
2. Truncated cone full metal jacket pistol bullets with a blunt tip and lead core,
3. Jacketed hollow point pistol bullets with lead core, and
4. Jacketed soft lead point pistol bullets with lead core.

The full metal jacket round nose bullets have been in use since the advent of the first semi-automatic pistols in the late 1800's and early 1900's. The round nose configuration was derived primarily to facilitate reliable feeding in magazine charged semi-automatic pistols. Little if any thought was then given to terminal-ballistic bullet effects.

Truncated cone full metal jacket pistol bullets have a blunt tip. They originated shortly after the full metal jacket round nose bullets around 1906. The German army adopted the 9 MM Lugar cartridge with a truncated cone full metal jacket bullet about 6 years later. The rational for the blunt nose was to deliver more kinetic energy to a target upon impact. The outer corner of the truncated cone bullet tip is radiused for reliable feeding.

Jacketed hollow point pistol bullets were developed after WWII. They were designed with the notion that the hollow cavity within the lead core would, upon impact with the human torso, cause the bullet to expand, thereby creating an enlarged wound cavity or channel. Jacketed hollow point bullets have a blunt nose profile similar to full metal jacket truncated cone bullets. The jacket on hollow point bullets extends around the outer diameter of the tip in a radius to insure reliable feeding.

The jacketed soft lead point pistol bullets are configured the same as full metal jacketed round nose projectiles. The soft lead point is thought to facilitate expansion upon bullet impact with a target. However, reliable feeding has been a problem with soft point bullets.

Recently, the law enforcement community hs adopted automatic pistols with greater fire power (8–17 shots) rather than retain the more traditional six shot revolver. An FBI weapons advisory committee recently conducted an evaluation of semi-automatic pistols and presented key findings relative to the incapacitation effectiveness of 9 mm and 0.45 automatic pistol ammunition. Some of their conclusions are as follows:

1. Because of the low velocities at which current pistol projectiles travel, jacketed hollow point bullets cannot be expected to reliably expand over the broad spectrum of law enforcement shooting situations.
2. If they do expand upon surface impact with the human torso, they cannot be relied upon to adequately penetrate to vital organs. The single most important factor in assessing the effectiveness of any pistol bullet is penetration.
3. Hits to the central nervous system, brain and spinal cord, are the only guarantee of causing instant incapacitation. Penetration of vital organs is the next best means of achieving incapacitation.
4. Incapacitation becomes more likely when there is greater tissue destruction which results in heavy bleeding.
5. Neither temporary cavitation caused by a pistol bullet or a kinetic energy deposit have a wounding effect.
6. To design an improved and effective anti-personal pistol bullet, two factors need to be taken into account.
   - 6*a*. The low internal ballistic effeciency level of commercially available pistol ammunition as compared to rifle ammunition.
   - 6*b*. The established shortcomings of existing commercially available pistol projectiles as regards their ability to effectively incompacitate human targets over the broad spectrum of shooting situations that are most frequently encountered by those in the law enforcement and military communities.

SUMMARY OF PRESENT INVENTION

The small arms bullet of the present invention shown in 0.45 caliber has six fins or ribs disposed at 60 degree intervals around the tip or front of the bullet. The fins extend from the axile center line radially outward to the bullet circumferential "diameter". The fins in effect form six pie-shaped segments that are radially disposed around the frontal extremity of the bullet. The fins form the truncated cone profile of the projectile tip.

The small arms bullet of the present invention has an improved capability to inflict wound incapacitation to human targets. The bullet has greater velocity because of lighter projectile weight. The cutting or lacerating effect of sharp corners on finned frontal edges and rearward tapered and circumferential finned surfaces are contemplated to cause profuse bleeding in the wound channel. The combined effect of superior penetration, velocity and ability of the curved surface of the bullet tip (pie-sectioned surfaces between the fins) which can be parabolic or elliptical in shape to generate a radial flow of blood, and bone particles into the wound channel (with resultant expansion of same) that will enlarge the lacerations and cuts inflicted by the sharp corners of the finned bullet surfaces and will thereby intensify bleeding.

This small arms bullet has the ability to penetrate hard mediums. This is due to its greater velocity, its reduced area of frontal extremity providing less initial target resistance, and its sharp leading edges, which are conducive to penetration rather than deflection which is typical of round nosed or radiused tip bullets.

This small arms bullet produces less recoil because its construction reduces bullet weight as compared to bullets in current use. There is no increase in its cost of manufacture as compared to current methods used to produce existing bullets.

This small arms bullet has the ability to reliably feed and function in automatic and semi-automatic weapons The tapered surfaces from front to rear on the outer finned segments of the bullet facilitates reliable feeding. Either one or two outer finned surfaces may contact the barrel feed ramp depending upon the rotational position of the cartridge as it is fed from the magazine.

This bullet regularly achieves adequate penetration due to the combined effects of the sharp corners of the frontal bullet surfaces, reduced area of the initial contacting frontal surfaces and increased velocity.

A molded plastic cap may be mounted to the bullet tip or frontal extremity. The cap inner female surface is configured to form a precision fit to the bullet tip. As previously indicated, a radiused bullet tip is necessary for reliable feeding but can cause bullet deflection rather than penetration if the bullet impacts a hard surface at an angle. The plastic bullet cap is configured to give the bullet frontal profile the same shape as the original 9 mm Parabellum jacketed round nose bullet. This bullet nose configuration has bee exceptional over the years for reliable feed and function in a variety of weapons.

The sharp angled corner of the bullet tip outer diameter, which mates to the inner surface of the plastic nose cap, upon impact with a target, will cause the plastic cap to disintegrate. This will allow the sharp bullet nose to penetrate the surface rather than deflect. Thus, bullet penetration will occur upon angled or straight on impact with a hard surface. The addition of the plastic nose cap also provides a superior aerodynamic configuration and a greatly reduced drag coefficient.

DETAILED DESCRIPTION OF ILLUSTRATIVE EMBODIMENT

Figure 1:
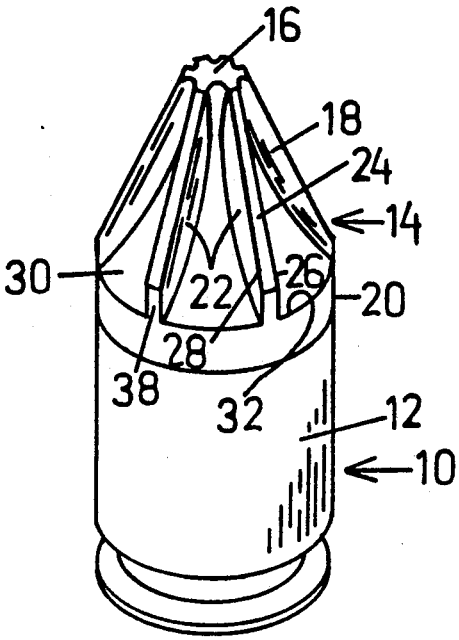
FIG. 1 is a perspective view of a 0.45 caliber pistol cartridge with the bullet of the present invention.

Reference is made to FIG. 1 wherein is shown cartridge 10 comprising a brass casing 12 with propellant not shown therein and a bullet 14 at the nose thereof. Except for the bullet configuration this cartridge is of state-of-the-art design for a 0.45 caliber pistol cartridge. This bullet configuration shows a preferred form of the present invention.

Bullet 14 has a circular nose 16 of reduced diameter on the order of 0.112 inches in 0.45 caliber. Six radially extending ribs 18 extend rearwardly and outwardly at intervals of 60 degrees and terminate at the exposed main bearing surface diameter 20 of the bullet that extends from the end of brass casing 12. Bearing surface 20 has a diameter in 0.45 caliber of 0.4515 inches. Ribs 18 have flat parallel side surfaces 22 providing a flat interconnecting surface 24 which defines a rib thickness in 0.45 caliber on the order of 0.040 inches. The side surfaces 22 and interconnecting surface 24 form right angle edges 26, 28.

Between the rib sides 22 of adjacent ribs is a grooved or hollowed out portion which has a curved surface 30 which can be parabolic or elliptical in shape extending from nose 16 to the bearing surface diameter 20. The curvature of this surface 30 is based upon the vertical height from nose 16 to the upper edge 32 of bearing surface diameter 20, in case of a 0.45 caliber bullet 0.350 inches, and the difference in radius of circular nose 16 and bearing surface diameter 20, in the case of a 0.45 caliber bullet 0.186 inches.

Figure 2:
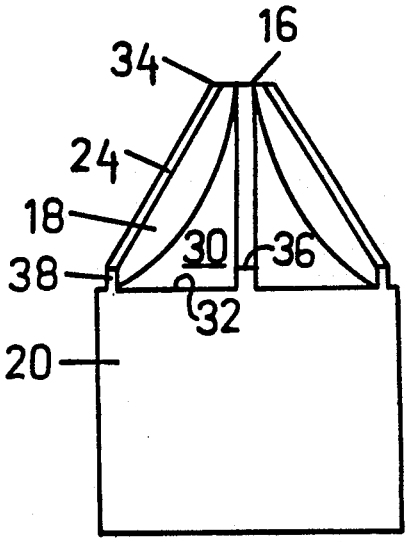
FIG. 2 is a side view of the bullet.
Figure 4:
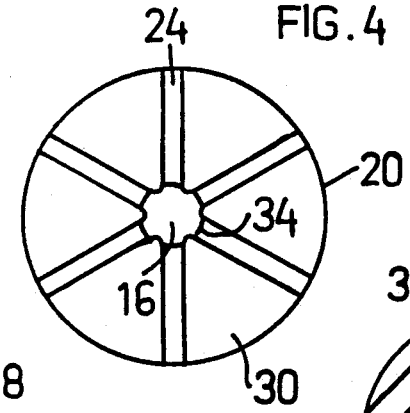
FIG. 4 is a plan view.
Figure 3:
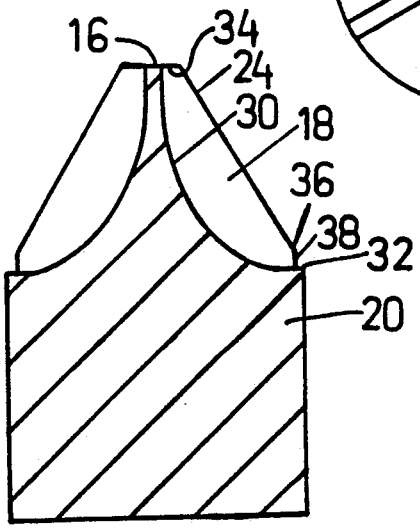
FIG. 3 is a side view in section.

FIGS. 2, 3 and 4 show other views of the invention bullet which causes superior incapacitation to the human target compared to bullets of current design, including jacketed expanding hollow point and full metal jacketed ball bullets. In this form, the circular nose 16 is smaller in a 0.45 caliber bullet, on the order of 0.080 inches. Ribs 18 terminate in a flat horizontal edge 34 connecting with this smaller nose 16. As can be seen in FIG. 4, each of these edges 34 are spaced from each other by a 0.01 inch radius to provide more cutting surfaces at the nose 16 of the bullet. The curved surface 30 extends from the nose 16 to an edge 32 approximately 0.050 inches below edge 36 where the 60 degree ribs 18 join the outer bullet diameter 20. This leaves a vertical lower surface 38 on rib 18.

Horizontal rib edge 34 and vertical surface 38 intersect at right angles to rib sides 22 and thus generate cuts or lacerations in the wound channel cavity which are dramatically exaggerated by the radial flow of blood, tissue and bone particles generated by the curved surface 30 upon impact with the human target. Surfaces 30 and 20 join at right angle edge 32 thereby forming an additional sharp cutting edge.

Figure 5:
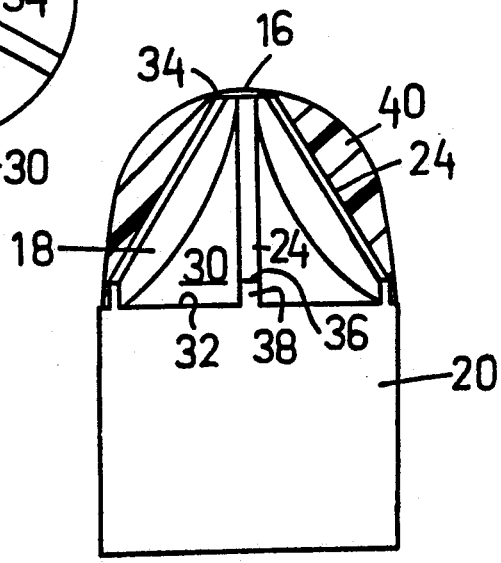
FIG. 5 is a side view with a plastic cap shown in section.

An additional improvement is shown in FIG. 5 wherein a plastic ballistic bullet cap 40, shown in section, covers the ribs 18 to give the appearance of a conventional bullet. This cap facilitates feed and function and also reduces drag. This cap facilitates feed and function and also reduces drag. This cap does not hinder angular penetration as it disintegrates and breaks up on impact and will not cause the bullet to deflect or ricochet.

It should be noted that bullets of the present inventive configuration will offer the best performance over the broad spectrum of shooting situations that are encountered by those in the military and law enforcement communities as compared to bullets of conventional configuration which rely on the principle of bullet expansion to cause incapacitition. The ability of the invention bullet to cause incapacitation is based on a completely different principal; its design takes full advantage of the exterior configuration in combination with faster bullet velocity compared with bullets of current design which are designed to expand on impact. This bullet in 0.45 caliber weighs approximately 143 grs. and achieved test muzzle velocities of just under 1300 ft./sec. compared to current design lead core, copper jacket 0.45 caliber bullets weighing between 185 and 230 grs. and achieving 750–900 ft./sec. muzzle velocity. It is believed that with further load development using different powders, the present invention bullet in 0.45 caliber may have an increased muzzle velocity (as compared to existing 0.45 caliber bullets) in the vicinity of 1400 ft./sec.

While the best immediate potential of the present inventive bullet exists in the handgun cartridge segment of the market, there is good potential for it in rifle cartridges as well as a saboted version of the bullet for use in shotgun shells and a version for 0.50 caliber machine gun rounds.

While preferred embodiments of the present invention have been illustrated and described using a 0.45 caliber pistol bullet as reference, it is to be understood that the number of fins may vary depending on the projectile diameter as a function of application. Also, in the case of a rifle bullet, the truncated cone tip shown herein may be altered to a more aerodynamic configuration to accommodate the higher velocities at which rifle projectiles travel. While the inventive bullet has been described in combination with a casing to for a typical cartridge having a bullet and casing, it is to be understood that it may be used with as-yet non-commercial caseless cartridges. Other modifications and improvements will readily occur to those skilled in the art, and it is to be understood that these alternatives and changes are to be considered as part of the present invention as set forth in the following claims.

What I claim is:

1. A small arms projectile, comprising:

(a) a substantially cylindrical main body;

(b) a front portion formed as one-piece with the main body and terminating in a flat front end which is smaller than the diameter of the main body;

(c) the front portion formed of a plurality of narrow ribs with parallel sides extending along their entire length, said ribs also extending radially outward and equally spaced around the front portion, the ribs extending from the main body to the flat front end, at least a major portion of the outer surface of the ribs continuously tapering from the outer diameter of the main body to the flat end; and (d) cavities formed between the ribs, at least a major portion of which form a continuously curved surface from the outer diameter of the main body inwardly toward the flat front end.

2. The small arms projectile of claim 1, wherein the plurality of ribs include six ribs equally spaced around the outer surface of the front portion.

3. The small arms projectile of claim 1, and further including the ribs extending a short distance along the diameter of the main body and then tapering linearly to the flat end.

4. The small arms projectile of claim 1, wherein the curved surface of the cavities is in the shape of a parabolic curve.

5. The small arms projectile of claim 1, wherein the curved surface of the cavities is in the shape of an elliptical curve.

6. The small arms projectile of claim 1, and further including cap means in the cavities for filling the spaces between adjacent ribs and forming a smooth outer surface on the front portion.

7. A small arms cartridge, comprising:

(a) a small arms projectile including;

(1) a substantially cylindrical main body;

(2) a front portion formed as one-piece with the main body and terminating in a flat front end which is smaller than the diameter of the main body;

(3) the front portion formed of a plurality of narrow ribs with parallel sides extending along their entire length, said ribs also extending radially outward and equally spaced around the front portion, the ribs extending from the main body to the flat front end, at least a major portion of the outer surface of the ribs continuously tapering from the outer diameter of the main body to the flat end;

(4) cavities formed between the ribs, at least a major portion of which form a continuously curved surface from the outer diameter of the main body inwardly toward the flat front end; and (b) a cartridge case for holding the main body, with a minor portion of the main body and front portion projecting out of the cartridge case.

* * * * *